United States Patent [19]

Rivera

[11] Patent Number: 5,033,607

[45] Date of Patent: Jul. 23, 1991

[54] HANDRAIL NEWEL GUIDE ASSEMBLY FOR AN ESCALATOR

[75] Inventor: James Rivera, Bristol, Conn.

[73] Assignee: Otis Elevator Company, Farmington, Conn.

[21] Appl. No.: 585,421

[22] Filed: Sep. 20, 1990

[51] Int. Cl.[5] ..... B66B 23/22

[52] U.S. Cl. ..... 198/335

[58] Field of Search ..... 198/335, 337, 841, 842; 193/35 MD

[56] References Cited

U.S. PATENT DOCUMENTS

| | | | |
|---|---|---|---|
| 2,632,550 | 3/1953 | Panter | 198/335 |
| 2,669,339 | 2/1954 | Hansen | 198/335 |
| 3,283,878 | 11/1966 | Rissler | 198/335 |
| 3,442,367 | 5/1969 | Van Voorhis | 198/335 |
| 3,595,364 | 7/1971 | Schoneweiss et al. | 198/335 |
| 3,623,589 | 11/1971 | Johnson et al. | 198/335 |
| 4,273,232 | 6/1981 | Saito et al. | 198/335 |
| 4,934,506 | 6/1990 | Rivera | 198/335 |

FOREIGN PATENT DOCUMENTS

| | | | |
|---|---|---|---|
| 0165990 | 1/1981 | Netherlands | 198/335 |
| 426148 | 12/1966 | Switzerland . | |

*Primary Examiner*—Joseph E. Valenza
*Assistant Examiner*—Tuan N. Nguyen
*Attorney, Agent, or Firm*—William W. Jones

[57] ABSTRACT

The newel guide for an escalator or moving walkway is formed from a curvilinear self-lubricating plastic cage which serves as a race for a plurality of steel ball bearings. The ball bearings are freely rotatable in appropriate recesses formed in the plastic cage, and the handrail inner surface contacts the ball bearings and slides over them around the newel.

4 Claims, 2 Drawing Sheets

HANDRAIL NEWEL GUIDE ASSEMBLY FOR AN ESCALATOR

DESCRIPTION

1. Technical Field

This invention relates to a handrail guide for the newel sections of an escalator or moving walkway.

2. Background Art

People movers such as escalators or moving walkways are generally configured so that the steps or treads move from an entrance landing to an exit landing, when transporting passengers, along a first path of travel, and then they reverse their direction of movement to return from the exit landing to the entrance landing along a second path of travel which lies directly beneath the first path of travel. They also generally include moving handrails mounted on step-flanking balustrades, which handrails follow somewhat similar transport and return paths of travel. When the handrails move from the transport to return paths of travel, and vice versa, they pass over curved newels at the ends of the balustrades. When the handrails move along a generally rectilinear path on the balustrades, they merely slide over fixed tracks mounted on the balustrades, but when the handrails pass over the newels which are curved, there would be too much friction generated if a fixed track were used, thus they must pass over a rolling guide. In the prior art, two different approaches have been used to guide the handrails around the curved newels. The first solution to the problem involved using a large rotating wheel or pulley at each newel. The wheels were hidden in the balustrade housing and the handrail passed from the track onto the wheel, and thence around the newel. U.S. Pat. No. 2,632,550, granted Mar. 24, 1953 to C. Panter; and U.S. Pat. No. 2,669,339, granted Feb. 16, 1954 to H. E. Hansen illustrate this solution to the problem. This solution was acceptable for earlier escalators which were relatively bulky mechanisms, but cannot be used in the streamlined, more modern escalators or walkways which have thin balustrades, often made of glass, or some other transparent material.

In the streamlined modern escalators and moving walkways, the solution to the problem involves the use of a plurality of spaced roller bearings mounted on the handrail guide rail along the newel portion thereof. The handrail rides on the roller bearings during passage over the newels. This solution is disclosed in U.S. Pat. No. 3,283,878, granted Nov. 8, 1966 to L. R. Rissler; U.S. Pat. No. 3,442,367, granted May 6, 1969 to D. E. Van Voorhis; U.S. Pat. No. 3,595,364, granted July 27, 1971 to K. Schoneweiss, et al.; U.S. Pat. No. 3,623,589, granted Nov. 30, 1971 to E. D. Johnson et al.; U.S. Pat No. 4,273,232, granted June 16, 1981 to C. Saito, et al; and Swiss Patent No. 426,148 dated Dec. 15, 1966. A problem which arises in connection with this solution concerns the use of the roller bearings. The roller bearings used employ a roller system which has a central ball roller set and flanking pin roller sets. The ball rollers are about 3 mm in diameter and the pin rollers are about 1.5 mm in diameter. In a standard escalator newel, the ball rollers rotate at about 100 rpm, and the pin rollers rotate faster. This high speed of rotation results in high heat generation and high levels of noise. It is also apparent that the rollers in the roller bearings are delicate and are known to require replacement at an undesirable frequency.

DISCLOSURE OF THE INVENTION

This invention relates to an improved handrail guide assembly for use in the newels of an escalator or moving walkway. The guide assembly of this invention is self-lubricating thereby requiring minimal servicing, and does not employ small ball bearing races. The guide assembly provides a rolling guidance for the handrail throughout the newels, and can be utilized in modern streamlined escalators or walkways which are equipped with transparent balustrades.

The guide assembly of this invention includes an elongated curved roller cage which is mounted on the curved ends of the balustrades. The cage is formed from a self lubricating, low coefficient of friction plastic such as polymer, or the like. The cage may be reinforced with a steel plate if need be. The cage is mounted on the balustrade glass by the same mount base that connects the handrail guide rail to the balustrade. A plurality of ball bearings are mounted in the cage and engage the handrail as the latter passes over the balustrade newels. The ball bearings are about 15 mm in diameter, which is five times the diameter of the roller bearing ball bearings. This means that the roller bearings need rotate only one-fifth of the speed, or 20 rpm, in guiding the moving handrail. The slower rotational speed, plus the point of contact between the ball bearings and the handrail results in generation of much less heat, and much less noise than the roller bearing newel guides. The low coefficient of friction of the plastic cage also cuts down on heat generation. Since the cage is self lubricating, minimal servicing requirements are achieved. The ball bearings are fitted into sockets in the cage which perform an additional function of providing a path wherein lint and other shedding from the inner handrail lining can move away from the handrail and pass through the cage to the mount below. This tends to keep the ball bearings clean and lint-free.

It is, therefore, an object of this invention to provide an improved escalator handrail guide assembly for installation on the newels of the escalator balustrade.

It is another object of this invention to provide a guide assembly of the character described which produces minimal noise and heat in operation.

It is a further object of this invention to provide a guide assembly of the character described which requires minimal maintenance.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 1:
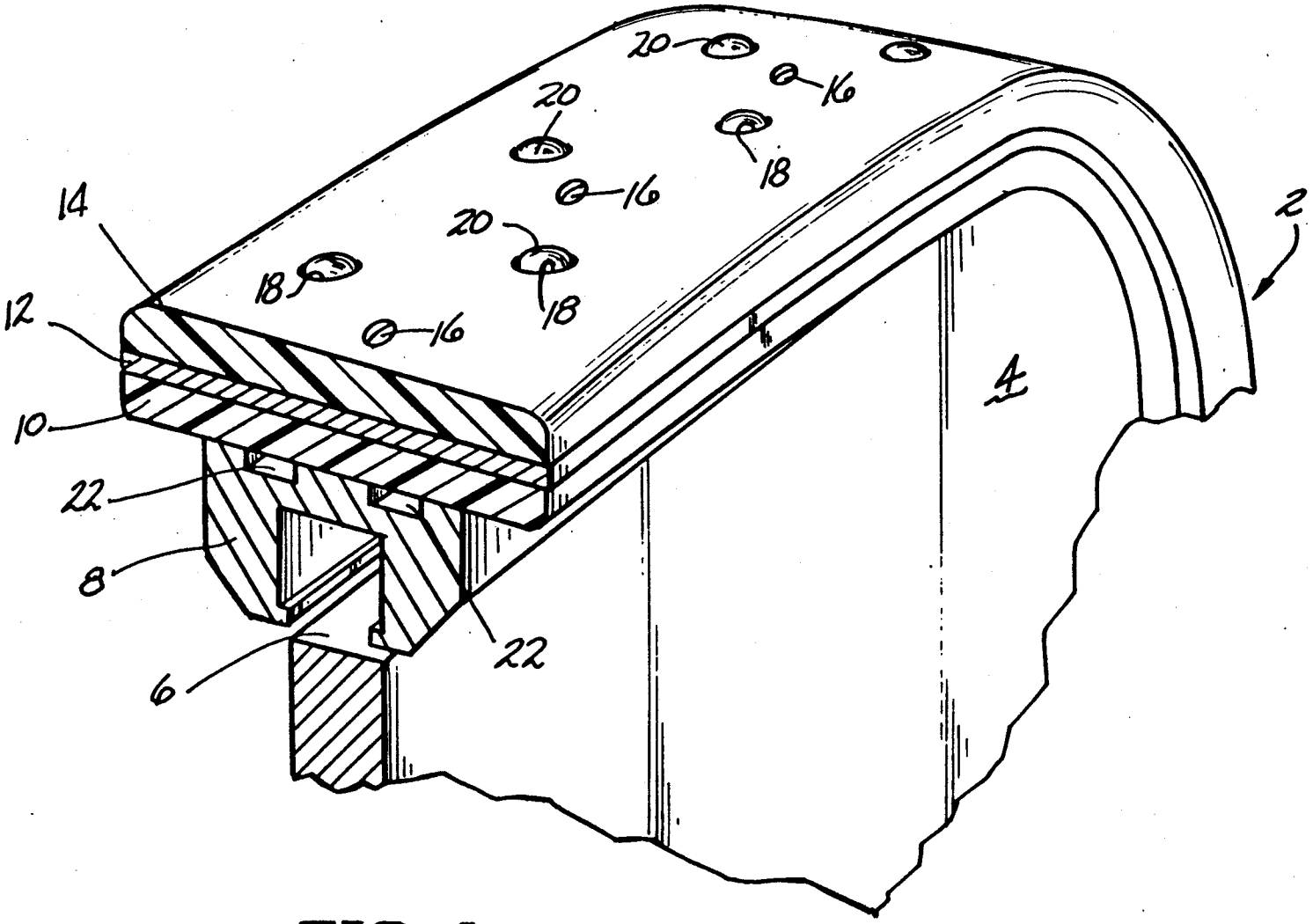
FIG. 1 is a fragmented perspective view of a preferred embodiment of the newel handrail guide of this invention.
Figure 2:
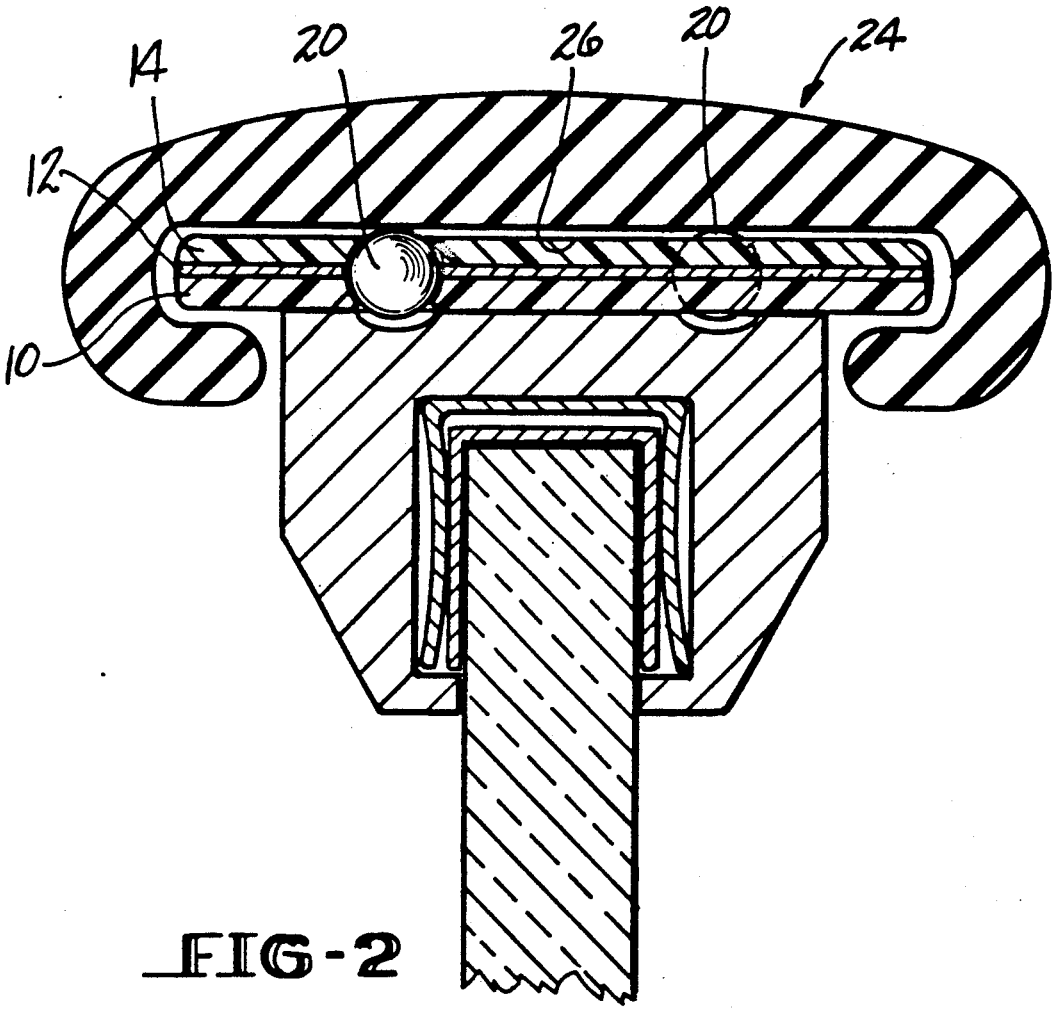
FIG. 2 is a cross-sectional view of the guide of FIG. 1 showing the handrail mounted thereon.

Referring now to FIG. 1, there is shown a fragment of one of the newels 2 on an escalator or moving walkway. The balustrade 4 is formed from glass and includes an upper edge 6 which is curvilinear in the newel 2. A mount base 8 of the type disclosed in U.S. Pat. No. 4,932,512 granted June 12, 1990 is mounted on the upper margin of the balustrade 4. The base 8 is preformed to conform to the angles of curvature of the newel 2. A first curved strip 10 of a polymer is mounted on the base 8 and extends laterally outwardly of the sides thereof. A steel reinforcing strip 12 is mounted on the strip 10, and a second curved strip 14 of a polymer is mounted on the steel strip 12. Screws 16 are used to secure the strips 10, 12 and 14 to the base 8. A plurality of sockets 18 are formed in the strips 10, 12 and 14, and receive ball bearings 20 which protrude above the top of the strip 14. The ball bearings 20 also protrude below the strip 10 into grooves 22 formed in the top of the base 8. The ball bearings 20 thus freely rotate in the sockets 18. As will be noted in FIG. 2, the under surface 26 of the handrail 24 contacts the ball bearings 20 and slides over the strips 10, 12 and 14 on the ball bearings 20.

Figure 3:
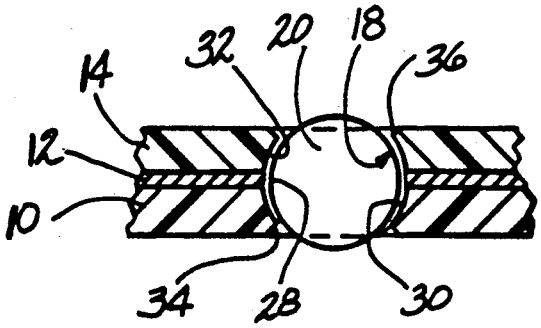
FIG. 3 is an enlarged fragmented sectional view of one of the ball bearing and cage socket mounts showing the debris passages therein.

FIG. 3 shows details of the sockets 18 and how the ball bearings 20 are mounted therein. The steel plate 12 has holes 28 formed therein which are slightly larger than the diameter of the ball bearings 20. Each plastic strip 10 and 14 has spherical recesses 30 and 32, respectively, formed therein on the sides of the strips 10 and 14 which face the steel strip 12. The recesses 30 and 32 are slightly larger in radius than the ball bearings 20. Chamfers 34 and 36 are formed in the surfaces of the strips 10 and 14 which face away from the steel strip 12. The ball bearings 20 are thus detained in the sockets 18 but can freely rotate therein. The free space between the ball bearings 20 and sockets 18 forms passages through the strips 10, 12 and 14 whereby debris flakes from the inner surface 26 of the handrail 24 can move through the sockets 18 to collect in the base grooves 22, thereby eliminating debris build up on the newel handrail guide.

It will be readily appreciated that the newel handrail guide of this invention is durable and trouble-free. Using the invention, less heat and lower noise levels are realized. The self-lubricating plastic cage lowers service costs. The construction of the newel guide allows it to directly abut the handrail guide rail used at the landings and inclines on the escalator. The lower resistance to movement of the handrail over the newels allows the guide of this invention to be used on the newels of a curved escalator.

Since many changes and variations of the preferred embodiment of the invention may be made without departing from the inventive concept, it is not intended to limit the invention otherwise than as required by the appended claims.

What is claimed is:

1. A handrail balustrade newel guide assembly for an escalator, moving walkway, or the like, said handrail guide assembly comprising:

a) a polymeric cage having a curvilinear configuration conforming to the configuration of the newel and extending from an upper end of the newel to a lower end of the newel, said cage being fixed to said balustrade; and b) a plurality of ball bearings mounted in said cage, said ball bearings being freely rotatable in said cage and disposed in guiding contact with the handrail whereby the handrail passes around the newel by sliding over the ball bearings.

2. The handrail guide assembly of claim 1 wherein said cage comprises a pair of coextensive strips of a high lubricity polymeric material, said strips including a plurality of matched sockets formed therein for reception and retention of said ball bearings.

3. The handrail guide assembly of claim 2 further comprising a reinforcing metal strip interposed between said polymeric material strips for strengthening said cage.

4. The handrail guide assembly of claim 3 further comprising a metal base fitted onto the balustrade, and said strips being fastened to said base, said base including at least one slot therein for allowing rotation of said ball bearings in said cage.

* * * * *